US005718193A

United States Patent [19]

Ban et al.

[11] Patent Number: 5,718,193

[45] Date of Patent: Feb. 17, 1998

[54] VISCOUS HEATER

[75] Inventors: Takashi Ban; Hidefumi Mori; Kiyoshi Yagi; Tatsuyuki Hoshino, all of Kariya, Japan

[73] Assignee: Kabushiki Kaisha Tayoda Jidoshokki Seisakusho, Kariya, Japan

[21] Appl. No.: 836,654

[22] PCT Filed: Aug. 12, 1995

[86] PCT No.: PCT/JP96/02288

§ 371 Date: Apr. 23, 1997

§ 102(e) Date: Apr. 23, 1997

[87] PCT Pub. No.: WO97/08000

PCT Pub. Date: Jun. 3, 1997

[30] Foreign Application Priority Data

Aug. 25, 1995 [JP] Japan ..... 7-217035
Jun. 18, 1996 [JP] Japan ..... 8-157134

[51] Int. Cl.[6] ..... F22B 3/06; F24C 9/00

[52] U.S. Cl. ..... 122/26; 126/247

[58] Field of Search ..... 126/247; 122/26; 123/142.5 R

[56] References Cited

U.S. PATENT DOCUMENTS

| | | | |
|---|---|---|---|
| 4,664,068 | 5/1987 | Kretchmer et al. | 122/26 |
| 4,733,635 | 3/1988 | Menard et al. | 126/247 |
| 4,773,388 | 9/1988 | Herbulot et al. | 126/247 |
| 4,993,377 | 2/1991 | Itakura . | |
| 5,419,306 | 5/1995 | Huffman | 126/247 |
| 5,573,184 | 11/1996 | Martin | 122/26 |

FOREIGN PATENT DOCUMENTS 2246823 10/1990 Japan .

*Primary Examiner*—Erick R. Solis
*Attorney, Agent, or Firm*—Brooks Haidt Haffner & Delahunty

[57] ABSTRACT

A viscous heater is provided which can be manufactured readily and less expensively. For instance, it includes a rear housing 6 which is constituted by a rear plate 2 and a rear housing body 3. The rear plate 2, the rear housing body 3 and a front housing 1 are overlapped and fastened by a through bolt 5, and thereby a rear water jacket RW is formed by the rear plate 2 and the rear housing body 3.

21 Claims, 10 Drawing Sheets

VISCOUS HEATER

TECHNICAL FIELD

The present invention relates to a viscous heater in which a viscous fluid is caused to generate heat by shearing. The resulting heat is utilized as a thermal source for heating by carrying out heat exchange with a circulating fluid which circulates in a radiator chamber.

BACKGROUND ART

Conventionally, in Japanese Unexamined Patent Publication (KOKAI) No. 2-246,823, a viscous heater is disclosed which is utilized as a heating apparatus for a vehicle. In this viscous heater, a front housing and a rear housing are disposed so as to face with each other, and are fastened by through bolts, thereby forming a heat-generating chamber and a water jacket therein. The water jacket is disposed around an outer region of the heat-generating chamber. In the water jacket, circulating water is circulated so that it is taken in through a water inlet port, and that it is delivered out to an external heating circuit through a water outlet port. In the front housing, a driving shalt is held rotatably via a bearing apparatus. To the driving shaft, a rotor is fixed so that it can rotate in the heat-generating chamber. A wall surface of the heat-generating chamber and an outer surface of the rotor constitute labyrinth grooves which approach to each other. In a space between the wall surface of the heat-generating chamber and the outer surface of the rotor, a viscous fluid, such as a silicone oil, is interposed.

In the viscous heater built into a vehicle heating apparatus, the rotor rotates in the heat-generating chamber when the driving shalt is driven by an engine. Accordingly, the viscous fluid is caused to generate heat by shearing in the space between the wall surface of the heat-generating chamber and the outer surface of the rotor. The thus generated heat is heat-exchanged to the circulating water in the water jacket. The heated circulating water is used at the heating circuit to heat a vehicle.

However, in the above-described conventional viscous heater, the heat-generating chamber, and the water jacket, which works as the radiator chamber, should be constituted by the front and rear housings only. The front and rear housings are independent component members, respectively, and accordingly they are formed as complicated configurations. Therefore, the viscous heater suffers from a disadvantage in that it is difficult to manufacture. As a result, the manufacturing cost of the viscous heater is pushed up.

Further, in the viscous heater, heat exchange cannot be carried out fully, because the surface area of the wall surface, which constitutes the water jacket, is relatively small, and because there is a fear of short-circuiting or residing the circulating water in the water jacket.

Furthermore, in the viscous heater, there is a fear of leaking the viscous fluid to the outside, because the heat-generating chamber is communicated with the outside by way of the bearing apparatus. In view of this, it is possible to think of disposing a shaft-sealing apparatus. However, when a shaft-sealing apparatus is simply provided, there remains a fear that a rubber-like material in the shaft-sealing apparatus is degraded by the thermal influence, which results from the viscous fluid held in the heat-generating chamber. Moreover, after durability, there also arises a fear of leaking the viscous fluid. This problem further results in mutual leakage among the viscous fluid held in the heat-generating chamber, the circulating fluid circulating in the radiator chamber and the outside air.

It is therefore a first assignment to the present invention to provide a viscous heater which can be manufactured readily and at reduced cost.

It is therefore a second assignment to the present invention to provide a viscous heater which can not only solve the first assignment but also can carry out full heat exchange securely.

It is therefore a third assignment to the present invention to provide a viscous heater which can not only solve the first and second assignments but also can reliably inhibit the mutual leaking among the viscous fluid, the circulating fluid and the outside air.

Measures for Solving the Assignment

A viscous heater set forth in claim 1 comprises:

a front housing and a rear housing in which a heat-generating chamber is formed;

a radiator chamber formed in one of the front and rear housings at least, neighboring the heat-generating chamber, and circulating a circulating fluid therein;

a driving shaft held rotatably to the front housing by way of a bearing apparatus;

a rotor disposed in the heat-generating chamber rotatably by the driving shaft; and a viscous fluid interposed in a space between a wall surface of the heat-generating chamber and an outer surface of the rotor, and caused to generate heat by the rotating rotor;

wherein at least one of the front and rear housings forming the radiator chamber includes a plate, and a housing body constituting the rest of at least one of the front and rear housings, the plate forming a wall surface of the heat-generating chamber with an axial end surface thereof and a wall surface of the radiator chamber with another axial end surface thereof; and the plate, the housing body and another one of the front and rear housings are overlapped and fastened by a through bolt.

The plate can preferably be constituted by a material, such as an aluminum-based material, a copper-based material, etc., which has such high thermal conductivity that full heat-exchange can be carried out. The housing body can preferably be constituted by a material, such as an iron-based material, etc., which has such low thermal conductivity that heat can be kept from leaking to the outside.

In the viscous heater set forth in claim 1, at least one of the front and rear housings includes the plate, and the housing body. Further, the plate, the housing body and another one of the front and rear housings are overlapped and fastened by a through bolt. Furthermore, the radiator chamber is formed by the plate and the housing body.

As a result, in the viscous heater set forth in claim 1, the plate, and the housing body are formed as simple configurations so that they can be manufactured readily.

A viscous heater set forth in claim 2 is characterized in that an outer peripheral portion of the housing body of the viscous heater set forth in claim 1 surrounds an outer peripheral end of the plate.

When fastening an outer peripheral portion of the housing body, or the like, only a relatively weak fastening force acts on a central portion thereof. Here, if the housing body and plate are of comparatively low rigidity for the purpose of weight reduction, the viscous fluid held in the heat-generating chamber is likely to leak to the outside, the viscous fluid is likely to leak into the radiator chamber, and the circulating fluid, circulating in the radiator chamber, is likely to leak to the outside.

In this respect, in the viscous heater set forth in claim 2, such a drawback can be prevented, because the outer peripheral portion of the housing body surrounds the outer peripheral end of the plate.

A viscous heater set forth in claim 3 is characterized in that the plate of the viscous heater set forth in claim 1 or 2 includes a convexity which protrudes at a central portion in an axial direction, and the housing body thereof includes a contacting portion which is brought into contact with the convexity in an axial direction or in a peripheral direction.

In the viscous heater set forth in claim 3, the plate and housing body are of high rigidity, because they are brought into contact with each other at the central portions. As a result, even when the outer peripheral portion of the housing body, or the like, is fastened by a through bolt, the viscous fluid held in the heat-generating chamber is less likely to leak to the outside, the viscous fluid is less likely to leak into the radiator chamber, and the circulating fluid, circulating in the radiator chamber, is less likely to leak to the outside.

A viscous heater set forth in claim 4 is characterized in that a sealing member is interposed between the plate and the housing body of the viscous heater set forth in claim 1, 2 or 3.

In the viscous heater set forth in claim 4, the viscous fluid held in the heat-generating chamber little leaks to the outside, the viscous fluid little leaks into the radiator chamber, and the circulating fluid, circulating in the radiator chamber, little leaks to the outside because the sealing member is interposed between the plate and the housing body.

A viscous heater set forth in claim 5 is characterized in that the sealing member of the viscous heater set forth in claim 4 is a gasket.

The viscous heater set forth in claim 5 embodies the means recited in claim 5 by a simple arrangement. Its operations will be described in a section of specific preferred embodiments.

A viscous heater set forth in claim 6 is characterized in that the sealing member of the viscous heater set forth in claim 4 is capable of displacing in an axial direction.

The circulating fluid is circulated not only in the radiator chamber, but also in the external heating circuit. Accordingly, when the resistance is high in the circuit, there arises a case where the extreme temperature increment occurs in the radiator chamber, because the circulating fluid resides in the radiator chamber and becomes less likely to absorb the heat generated in the heat-generating chamber. If such is the case, the viscous fluid is expanded to increase the pressure in the heat-generating chamber. Consequently, the plate and housing body are displaced in an axial direction against their rigidity. As a result, there arises a fear of leaking the viscous fluid to the outside or into the radiator chamber. Moreover, under the aforementioned circumstances, the pressure is increased in the radiator chamber although the pressure increment is relatively lower than the pressure increment in the heat-generating chamber. Accordingly, there likewise arises a fear of the leaking the circulating fluid to the outside.

In this respect, in the viscous heater set forth in claim 6, even when the plate and housing body are displaced in an axial direction by the highly pressurized heat-generating chamber or radiator chamber, the sealing member capable of displacing in an axial direction can securely seal between the plate and the housing body. As for the sealing member, an X-ring, a square ring, etc., can be selected optionally in addition to an O-ring set forth in claim 8 below.

A viscous heater set forth in claim 7 is characterized in that the gasket of the viscous heater set forth in claim 5 is interposed between an outer peripheral portion of the housing body and an outer peripheral portion of the plate, or the axially-displaceable sealing member of the viscous heater set forth in claim 6 is interposed between a central portion of the housing body and a central portion of the plate.

After a viscous heater is once assembled into a vehicle, the circulating fluid in the radiator chamber can be readily replenished or replaced, but the viscous fluid in the heat-generating chamber can be hardly replenished or replaced. Moreover, as mentioned above, the pressure increment in the heat-generating chamber is much more extreme than the pressure increment in the radiator chamber. Hence, the leakage of the viscous fluid should be securely inhibited.

In this respect, the viscous heater set forth in claim 7, the axially-displaceable sealing member can reliably inhibit the viscous fluid held in the heat-generating chamber from leaking to the outside, and the viscous fluid from leaking into the radiator chamber. Moreover, the gasket can easily keep the circulating fluid circulating in the radiator chamber from leaking to the outside.

A viscous heater set forth in claim 8 is characterized in that the axially-displaceable sealing member of the viscous heater set forth in claim 6 or 7 is an O-ring.

The viscous heater set forth in claim 8 embodies the means recited in claim 6 or 7 by a simple arrangement. Its operations will be described in a section of specific preferred embodiments.

A viscous heater set forth in claim 9 is characterized in that the plate of the viscous heater set forth in claim 1 or 2 has a convexity which protrudes in an axial direction at a central portion thereof; the housing body thereof has a contacting portion which is brought into contact with the convexity in a peripheral direction; and an O-ring is interposed between a peripheral surface of the convexity and a peripheral surface of the contacting portion.

In the viscous heater set forth in claim 9, when the plate and housing body are displaced in an axial direction, the O-ring allows their displacements, and seals securely between them while keeping the degree of elastic deformation in the O-ring itself identical.

A viscous heater set forth in claim 10 is characterized in that the plate of the viscous heater set forth in claim 1 or 2 has a convexity which protrudes in an axial direction at a central portion thereof; the housing body thereof has a contacting portion which is brought into contact with the convexity in an axial direction; and an O-ring is interposed between an end surface of the convexity and an end surface of the contacting portion.

In the viscous heater set forth in claim 10, when the plate and housing body are displaced in an axial direction, the O-ring allows their displacements, and seals securely between them while varying the degree of elastic deformation in the O-ring itself.

A viscous heater set forth in claim 11 is characterized in that the plate of the viscous heater set forth in claim 1 or 2 has a convexity which protrudes in an axial direction at a central portion thereof; the housing body thereof has a contacting portion which is brought into contact with the convexity in an axial direction; and an O-ring is interposed between a corner of the convexity and a corner of the contacting portion.

In the viscous heater set forth in claim 11, the O-ring operates intermediately between the O-rings recited in claims 9 and 10.

A viscous heater set forth in claim 12 is characterized in that a wall surface of the plate or the housing body, forming the radiator chamber, of the viscous heater set forth in claim 1, 2, 3, 4, 5, 6, 7, 8, 9, 10 or 11 constitutes a fin which protrudes in an axial direction.

In the viscous heater set forth in claim 12, the radiator chamber has a comparatively large surface area, because the wall surface of the plate or the housing body, forming the radiator chamber, constitutes the fin. Here, the fin protrudes in an axial direction, and accordingly little impairs the simple configuration of the plate or the housing body. Thus, the viscous heater can also be readily manufactured.

A viscous heater set forth in claim 13 is characterized in that a leading end of the fin of the viscous heater set forth in claim 12 is brought into contact with the housing body or the plate.

In the viscous heater set forth in claim 13, the fin is brought into contact with the housing body or the plate at the leading end. Therefore, heat is likely to be transferred because of the direct contact between the plate and the housing body.

A viscous heater set forth in claim 14 is characterized in that the rear housing, forming the rear radiator chamber, of the viscous heater set forth in claim 1, 2, 3, 4, 5, 6, 7, 8, 9, 10, 11, 12 or 13 includes a rear plate, and a rear housing body constituting the rest of the rear housing, the rear plate forming a rear wall surface of the heat-generating chamber with a front end surface thereof and a front wall surface of the rear radiator chamber with a rear end surface thereof; and that the rear plate and the rear housing body are brought into contact with each other at central regions thereof.

In the viscous heater set forth in claim 14, the rear housing includes the rear plate, and the rear housing body, and these members constitute the rear radiator chamber. Here, the rear plate and the rear housing body are brought into contact with each other at central regions thereof. As a result, heat is likely to be transferred because of the direct contact between the rear plate and the rear housing body. Moreover, the circulating fluid is circulated along a specific route in the radiator chamber.

A viscous heater set forth in claim 15 is characterized in that the radiator chamber of the viscous heater set forth in claim 1, 2, 3, 4, 5, 6, 7, 8, 9, 10, 11, 12, 13 or 14 is constituted so as to circulate the circulating fluid, taken in through a first port, along a specific route, and to deliver the circulating fluid out to the external heating circuit through a second port.

In the viscous heater set forth in claim 15, the circulating fluid, taken in through the first port, is circulated along a specific route in the radiator chamber, and is delivered out to the external heating circuit through the second port. Thus, there is no fear of short-circuiting or residing the circulating water in the radiator chamber.

A viscous heater set forth in claim 16 is characterized in that the first port and the second port of the viscous heater set forth in claim 15 are formed in an identical surface.

In the viscous heater set forth in claim 16, the first port and the second port are formed in an identical surface. Consequently, the viscous heater can be manufactured readily, and is good in terms of boardability on a vehicle, or the like.

A viscous heater set forth in claim 17 is characterized in that the first port and the second port of the viscous heater set forth in claim 16 are disposed next to each other.

In the viscous heater set forth in claim 17, the first port and the second port are disposed next to each other. Accordingly, the viscous heater is much better in terms of boardability on a vehicle, or the like.

A viscous heater set forth in claim 18 is characterized in that the front housing, forming the front radiator chamber, of the viscous heater set forth in claim 15, 16 or 17 includes a front plate, and a front housing body constituting the rest of the front housing, the front plate forming a front wall surface of the heat-generating chamber with a rear end surface thereof and a rear wall surface of the front radiator chamber with a front end surface thereof;

that the rear housing, forming the rear radiator chamber, of the viscous heater includes a rear plate, and a rear housing body constituting the rest of the rear housing, the rear plate forming a rear wall surface of the heat-generating chamber with a front end surface thereof and a front wall surface of the rear radiator chamber with a rear end surface thereof; and that a plurality of fluid passages communicate from one of the front radiator chamber and the rear radiator chamber, in which the first port and the second port are formed, to another one thereof.

In the viscous heater set forth in claim 18, the front housing includes the front plate, and the front housing body, and these members constitute the front radiator chamber. Further, in the viscous heater, the rear housing includes the rear plate, and the rear housing body, and these members constitute the rear radiator chamber. Furthermore, a plurality of the fluid passages communicate from one of the front radiator chamber and the rear radiator chamber, in which the first port and the second port are formed, to another one thereof. Thus, heat exchange can be carried out efficiently through the fluid passages as well.

A viscous heater set forth in claim 19 is characterized in that the fluid passages of the viscous heater set forth in claim 18 are formed to have an identical cross-sectional area, respectively.

In the viscous heater set forth in claim 19, the fluid passages can be readily processed, because they are formed to have an identical cross-sectional area, respectively.

A viscous heater set forth in claim 20 is characterized in that the fluid passages of the viscous heater set forth in claim 18 are formed to have a smaller cross-sectional area near the first port, and are formed to have a larger cross-sectional area away from the first port.

In the viscous heater set forth in claim 20, the circulating fluid can flow in the fluid passages in a flow rate of identical extent, because the fluid passages are formed to have a smaller cross-sectional area near the first port, and are formed to have a larger cross-sectional area away from the first port. Therefore, efficient heat exchange can be carried out.

A viscous heater set forth in claim 21 is characterized in that the front housing, forming the front radiator chamber, of the viscous heater set forth in claim 1, 2, 3, 4, 5, 6, 7, 8, 9, 10, 11, 12, 13, 14, 15, 16, 17, 18, 19 or 20 includes a front plate, and a front housing body constituting the rest of the front housing, the front plate forming a front wall surface of the heat-generating chamber with a rear end surface thereof and a rear wall surface of the front radiator chamber with a front end surface thereof;

that the front plate or the front housing body is provided with a shaft-sealing apparatus which seals the driving shaft between the heat-generating chamber and the bearing apparatus; and that the front radiator chamber is formed adjacent to the shaft-sealing apparatus.

In the viscous heater set forth in claim 21, the front housing includes the front plate, and the front housing body, and these members constitute the front radiator chamber.

Here, there is no fear of leaking the viscous fluid to the outside, because the front plate or the front housing body is provided with the shaft-sealing apparatus which seals the driving shaft between the heat-generating chamber and the bearing apparatus. In particular, a rubber-like material in the shaft-sealing apparatus is cooled indirectly by the circulating fluid which circulates in the radiator chamber, because the front radiator chamber is formed adjacent to the shaft-sealing apparatus. Accordingly, the fear of deteriorating the rubber-like material by the thermal influence, which results from the viscous fluid held in the heating chamber, is diminished. Moreover, a temperature increment is thereby realized in the circulating fluid.

BEST MODE FOR CARRYING OUT THE INVENTION

First through Fifth Preferred Embodiments embodying the present invention set forth in the appended claims, and a Modified Version will be hereinafter described with reference to the drawings.

(First Preferred Embodiment)

The viscous heater of the First Preferred Embodiment embodies claims 1, 4, 5, and 12 through 17.

Figure 1:
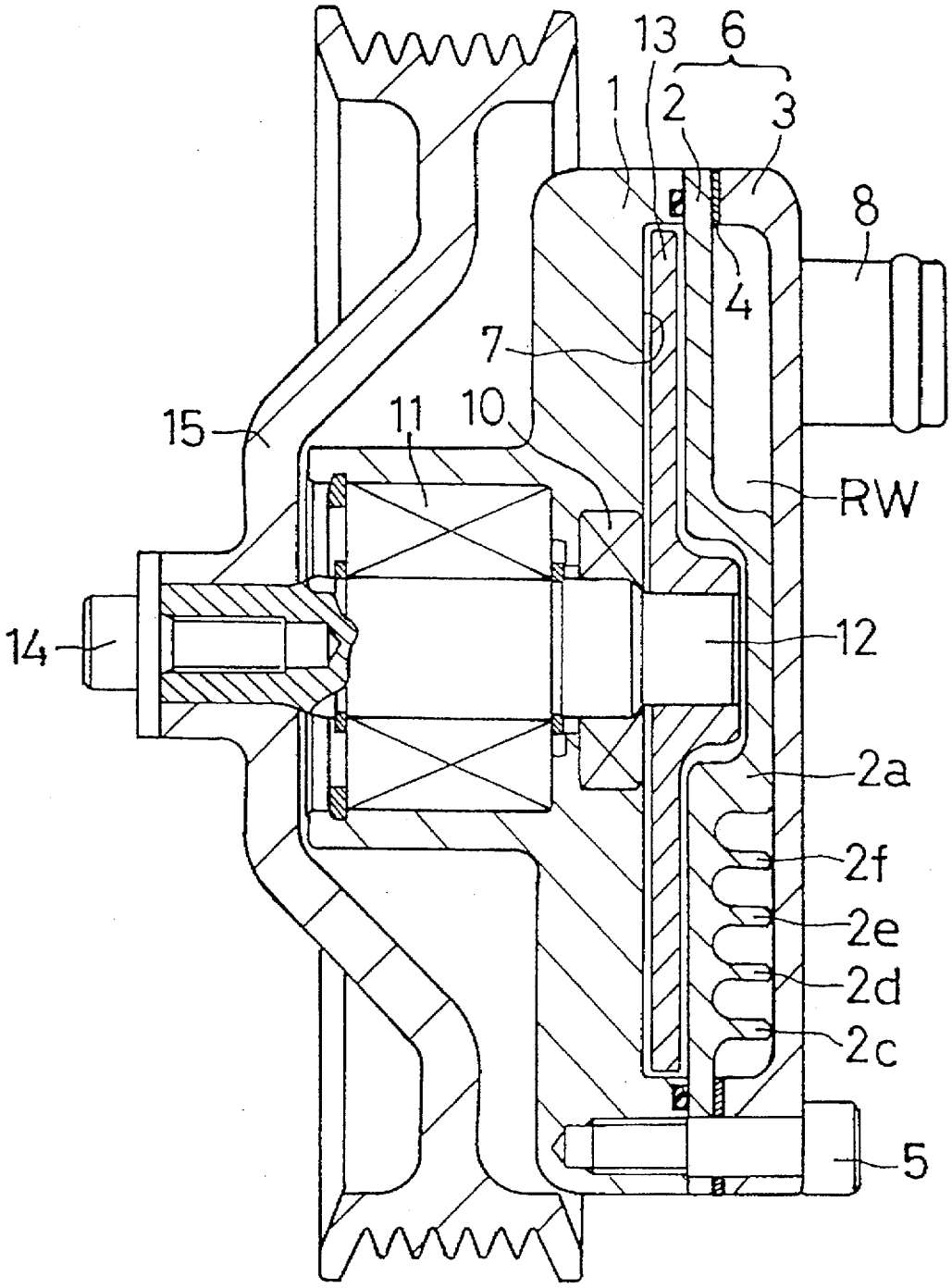
FIG. 1 is a vertical cross-sectional view of a viscous heater of a First Preferred Embodiment.

As illustrated in FIG. 1, in the viscous heater, a front housing 1, a rear plate 2 and a rear housing body 3 are overlapped and fastened by a plurality of through bolts 5 with a gasket 4 interposed between the rear plate 2 and the rear housing body 3. The gasket 4 works as the sealing member. Here, the rear plate 2 and the rear housing body 3 constitute the rear housing 6. The rear plate 2 is formed of an aluminum-based material having high heat conductivity in order to carry out full heat exchange. The front housing 1 and rear housing body 3 are formed of an iron-based material having low thermal conductivity so as not to let leak heat to the outside. Further, a concavity is dented in a rear-end surface of the front housing 1, and forms a heat-generating chamber 7 together with a flat front-end surface of the rear plate 2. Furthermore, a rear-end surface of the rear plate 2 and an inner surface of the rear housing body 3 form a rear water jacket RW. The rear water jacket RW works as the rear radiator chamber neighboring the heat-generating chamber 7. Thus, in the viscous heater, the rear plate 2 and the rear housing body 3 are formed as a simple configuration, respectively, and can be manufactured with ease. Note that the circulating water, working as the circulating fluid and circulating in the rear radiator chamber RW, hardly leaks to the outside, because the gasket 4 is interposed between the rear plate 2 and the rear housing body 3.

Figure 2:
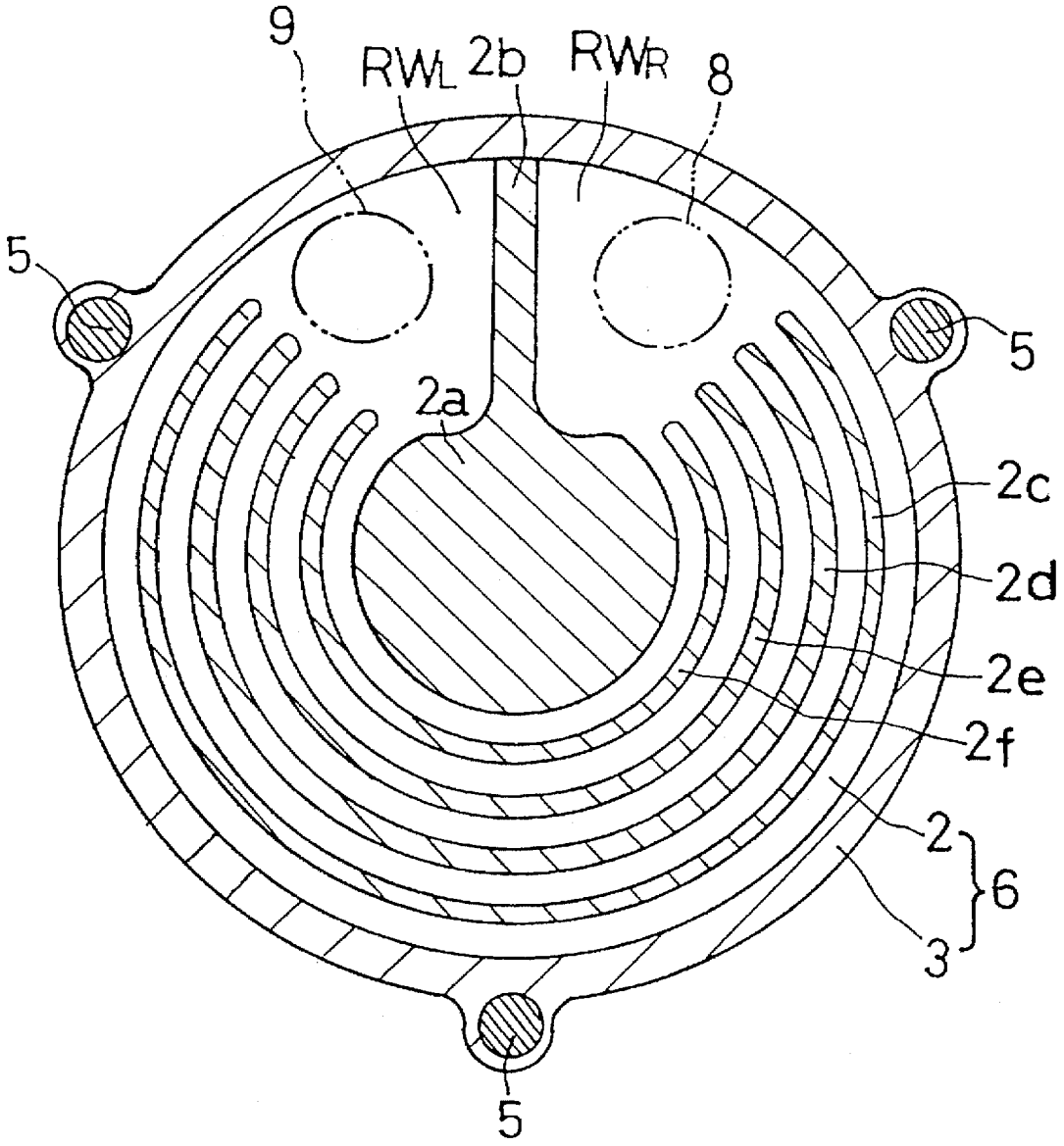
FIG. 2 is a horizontal cross-sectional view of the viscous heater of the First Preferred Embodiment.

As illustrated in FIG. 2, in an outer region on a rear surface of the rear housing body 3, a water inlet port 8 and a water outlet port 9 are formed next to each other. The water inlet port 8 works as the first port for taking in circulating water operating as the circulating fluid from an external heating circuit (not shown). The water outlet port 9 works as the second port for delivering the circulating water out to the heating circuit. The water inlet port 8 and the water outlet port 9 are communicated with the rear water jacket RW. Thus, in the viscous heater, the water inlet port 8 and the water outlet port 9 are formed next to each other in the identical surface. As a result, the viscous heater can be manufactured readily, and is good in terms of boardability on a vehicle.

On a rear-end surface of the rear plate 2, a cylindrical convexity **2*a* is protruded in a central area. Further, a partition wall 2*b*, which extends from the convexity 2*a* in a radial direction, is protruded between the water inlet port 8 and the water outlet port 9. Furthermore, on the rear-end surface of the rear plate 2, four streaks of fins 2*c* through 2*f* are protruded in an axial direction. The fins 2*c* through 2*f* extend like an arc around the convexity 2*a* from an area adjacent to the water inlet port 8 to another area adjacent to the water outlet port 9. Thus, in the viscous heater, the surface area is enlarged relatively by the fins 2*c* through 2*f*. Here, the fins 2*c* through 2*f* protrude in an axial direction, and little impair the simple configuration of the rear plate 2. Consequently, the rear plate 2** can also be manufactured readily.

As illustrated in FIG. 1, the leading end of the convexity **2*a*, the partition wall 2*b* and the fins 2*c* through 2*f* contacts with the inner surface of the rear housing body 3. Accordingly, in the viscous heater, heat is likely to be transmitted by the direct contact between the rear plate 2 and the rear housing body 3**.

In addition, a shaft-sealing apparatus 10, and a bearing apparatus 11 are disposed so as to neighbor the heat-generating chamber 7 in the front housing 1. By way of the shaft-sealing apparatus 10 and the bearing apparatus 11, a driving shaft 12 is hem rotatably. At the trailing end of the driving shaft 12, a plate-shaped rotor 13 is press-fitted so that it can rotate in the heat-generating chamber 7. The rotor 13 can preferably be formed of a material which differs from that of the rear plate 2 if the both of the members should interfere with each other. Moreover, in view of the torque transmitted from the driving shaft 12, the rotor 13 is constituted by an iron-based material. A silicone oil is interposed in the space between the wall surface of the heat-generating chamber 7 and the outer surface of the rotor 13. The silicone oil works as the viscous fluid. Thus, in the viscous heater, there is no fear of leaking the silicone oil to the outside, because the shaft-sealing apparatus 10 is disposed between the heat-generating chamber 7 and the bearing apparatus 11 in the front housing 1. At the leading end of the driving shaft 12, a pulley 15 is fixed by a bolt 14. The pulley 15 is rotated by a vehicle engine via a belt.

In the viscous heater built-into a vehicle heating apparatus, the rotor 13 is rotated in the heat-generating chamber 7 when the driving shaft 12 is driven by the engine by way of the pulley 15. Accordingly, the silicone oil is sheared in the space between the wall surface of the heat-generating chamber 7 and the outer surface of the rotor 13, thereby generating heat. The resulting heat is heat-exchanged to the circulating water flowing in the rear water jacket RW, and the thus heated circulating water is used for heating a vehicle in the heating circuit.

Figure 3:
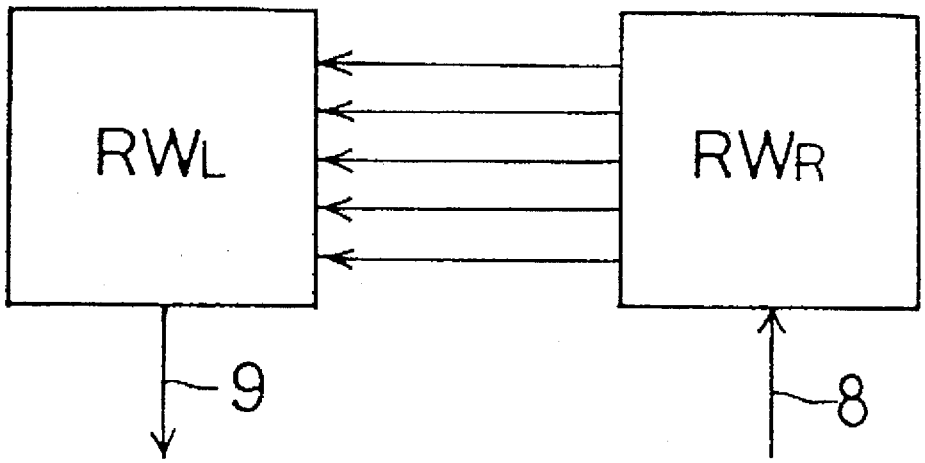
FIG. 3 is concerned with the viscous heater of the First Preferred Embodiment, and is a schematic diagram for illustrating a flow of circulating water therein.

At this moment, as illustrated in FIG. 3, the circulating water is taken in into a right-side chamber $RW_R$, viewed from the rear of the rear water jacket RW, through the water inlet port 8. The circulating water then follows the 5 streaks of routes, which are divided by the convexity 2*a*, the partition wall 2*b* and the fins 2*c* through 2*f*, and arrives at a left-side chamber RWL, viewed from the rear of the rear water jacket RW. Eventually, the circulating water is delivered out to the heating circuit through the water outlet port 9. Thus, in the viscous heater, there is no fear of short-circuiting or residing the circulating water in the rear water jacket RW, because the circulating water is circulated along the specific routes in the rear water jacket RW.

As a result, the viscous heater can be manufactured easily and less expensively, and is capable of carrying out full heat exchange.

Note that, instead of the pulley 15, an electromagnetic clutch can be employed to intermittently drive the driving shaft 12.

(Second Preferred Embodiment)

The viscous heater of the Second Preferred Embodiment embodies claims 1, 4, 5, 14 through 19, and 21.

Figure 4:
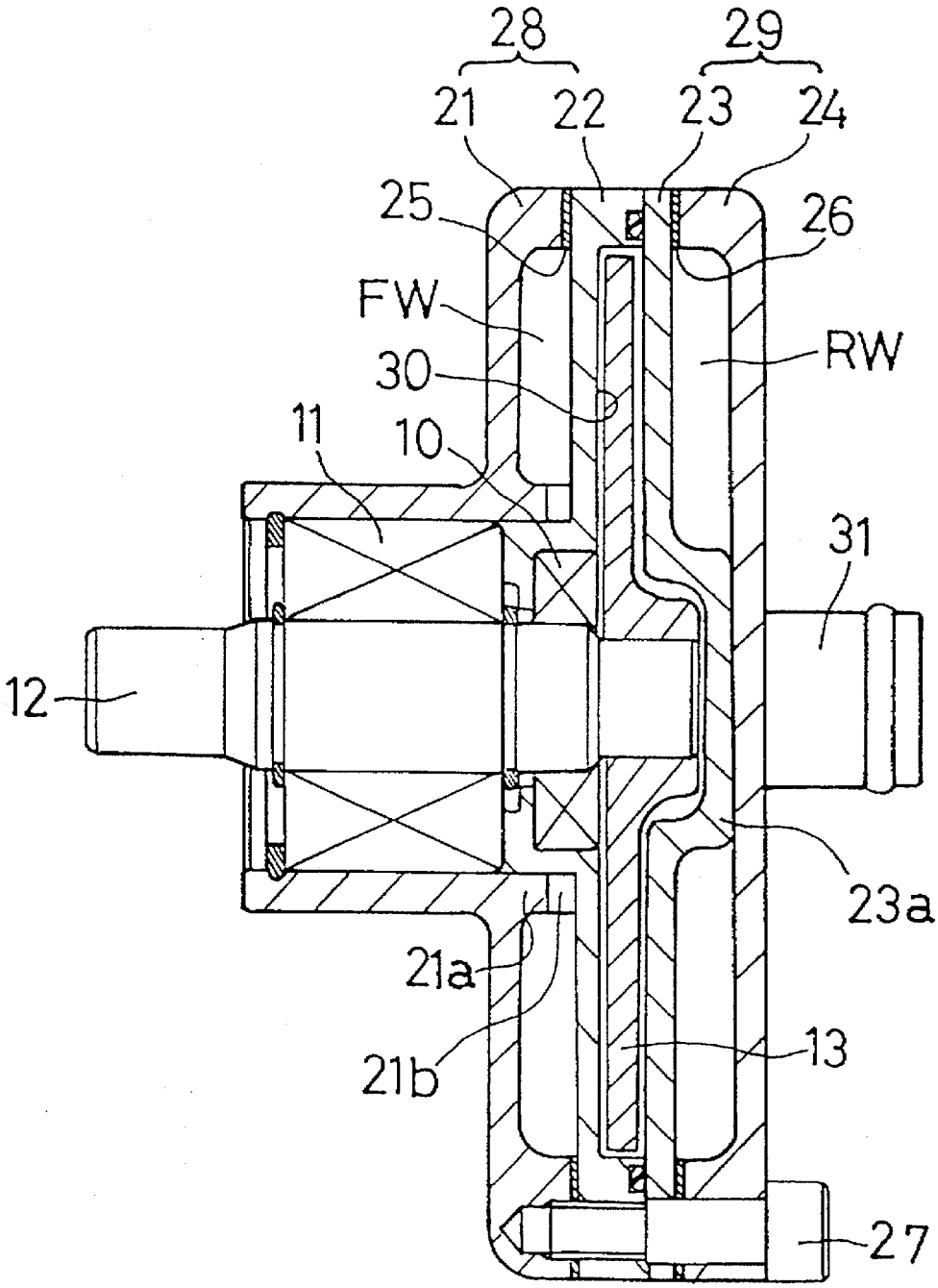
FIG. 4 is a vertical cross-sectional view of a viscous heater of a Second Preferred Embodiment.

As illustrated in FIG. 4, in the viscous heater, a front housing body 21, a front plate 22, a rear plate 23 and a rear housing body 24 are overlapped and fastened by a plurality of through bolts 27 with a gasket 25 interposed between the front housing body 21 and the front plate 22, and with a gasket 26 interposed between the rear plate 23 and the rear housing body 24. The gaskets 25, 26 work as the sealing member. Here, the front housing body 21 and the front plate 22 constitute a front housing 28, and the rear plate 23 and the rear housing body 24 constitute a rear housing body 29. The front plate 22 is formed of an aluminum-based alloy. Further, a concavity is dented in a rear-end surface of the front plate 22, and forms a heat-generating chamber 30 together with a flat front-end surface of the rear plate 23. Furthermore, an inner surface of the front housing body 21 and a front-end surface of the front plate 22 form a front water jacket FW. The front water jacket FW works as the front radiator chamber neighboring in front the heat-generating chamber 30. Moreover, a rear-end surface of the rear plate 23 and an inner surface of the rear housing body 24 form a rear water jacket RW. The rear water jacket RW works as the rear radiator chamber neighboring in rear of the heat-generating chamber 30. Thus, in the viscous heater, the front housing body 21, the front plate 22, the rear plate 23 and the rear housing body 24 are formed as a simple configuration, respectively, and can be manufactured with ease. Note that the circulating water, working as the circulating fluid and circulating in the front and rear water jackets FW and RW, hardly leaks to the outside, because the gasket 25 is interposed between the front housing body 21 and the front plate 22, and because the gasket 26 is interposed between the rear plate 23 and the rear housing body 24.

Figure 5:
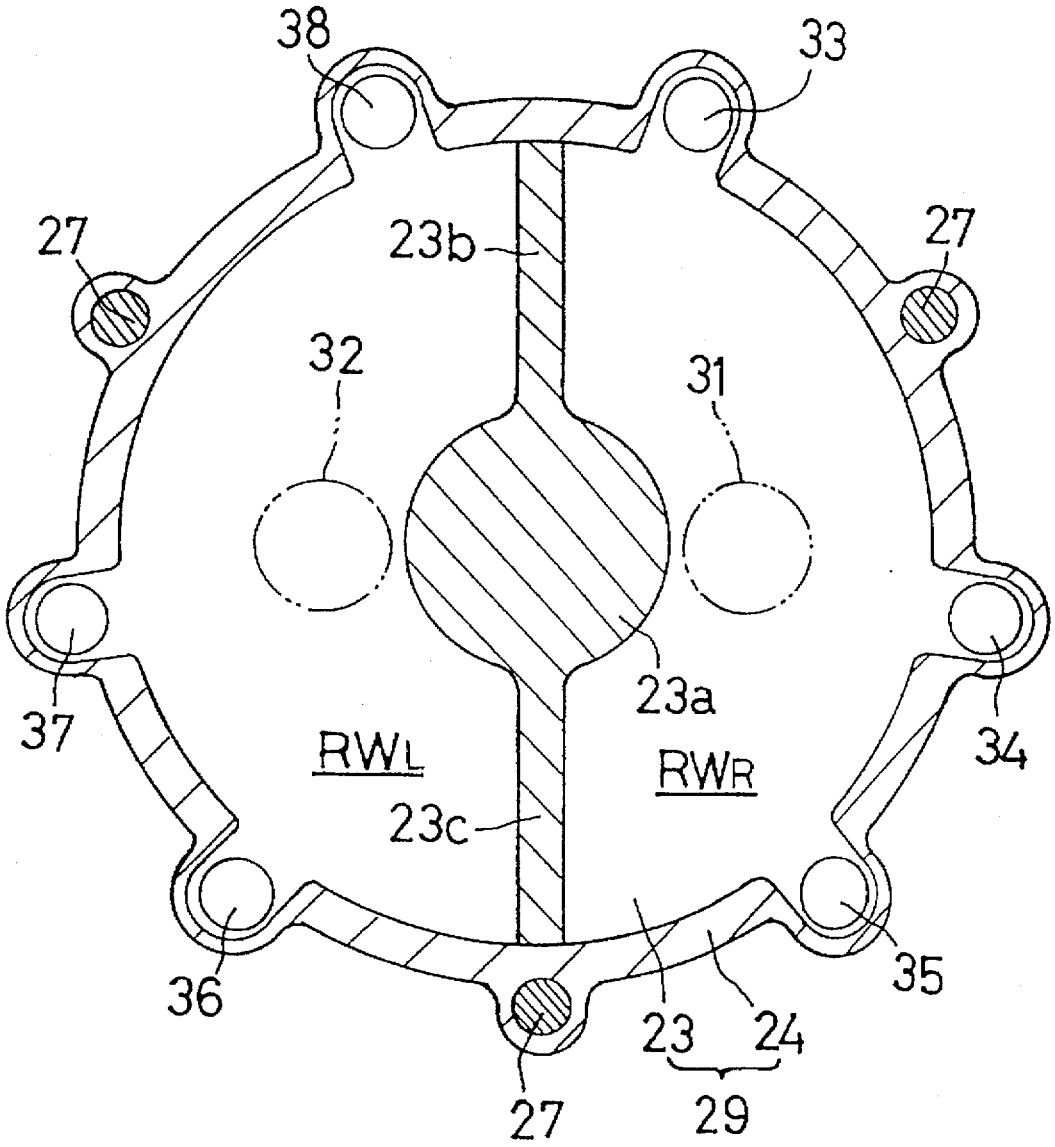
FIG. 5 is a horizontal cross-sectional view of the viscous heater of the Second Preferred Embodiment.

As illustrated in FIG. 5, in a central region on a rear surface of the rear housing body 24, a water inlet port 31 and a water outlet port 32 are formed next to each other. The water inlet port 31 works as the first port for taking in circulating water operating as the circulating fluid from an external heating circuit (not shown). The water outlet port 32 works as the second port for delivering the circulating water out to the heating circuit. The water inlet port 31 and the water outlet port 32 are communicated with the rear water jacket RW. Thus, in the viscous heater as well, the water inlet port 31 and the water outlet port 32 are formed next to each other in the identical surface. As a result, the viscous heater can be manufactured readily, and is good in terms of boardability on a vehicle.

On a rear-end surface of the rear plate 23, a cylindrical convexity 23*a* is protruded in a central area, and partition walls 23*b* and 23*c* are protruded between the water inlet port 31 and the water outlet port 32. Moreover, the partition walls 23*b* and 23*c* extend from the convexity 23*a* in opposite radial directions.

Here, as illustrated in FIG. 4, the leading end of the convexity 23*a*, and the partition walls 23*b* and 23*c* contacts with the inner surface of the rear housing body 24. Accordingly, in the viscous heater as well, heat is likely to be transmitted by the direct contact between the rear plate 23 and the rear housing body 24.

As illustrated in FIG. 5, in the gasket 26, the rear plate 23, the front plate 22 and the gasket 25, water passages 33 through 38 are drilled through, and are disposed between the through bolts 27 at equal intervals. The water passages 33 through 38 work as the fluid passage. Further, the water passages 33 through 38 are formed as a round hole having the same cross-sectional area, and can be processed with ease. Furthermore, the water passages 33 through 35 are communicated from the rear water jacket RW, in which the water inlet port 31 is formed, to the front water jacket FW, and the water passages 36 through 38 are communicated from the front water jacket FW to the rear water jacket RW, in which the water outlet port 32 is formed.

As illustrated in FIG. 4, a shaft-sealing apparatus 10, being similar to that of the First Preferred Embodiment, is disposed in the front plate 22. Further, a bearing apparatus 11, being similar to that of the First Preferred Embodiment, is disposed in the front housing body 21. Furthermore, an inner boss 21*a* is protruded in the front housing body 21, and is extended to the side of the heat-generating chamber 30 in an axial direction. A plurality of openings 21*b* are drilled through the inner boss 21*a* on the side of the shaft-sealing apparatus 10. Accordingly, the front water jacket FW is formed adjacent to the shaft-sealing apparatus 10 by leaving a thickness of the front plate 22 only. Thus, in the viscous heater, there is no fear of leaking the silicone oil to the outside, because the shaft-sealing apparatus 10 is disposed between the heat-generating chamber 30 and the bearing apparatus 11 in the front plate 22.

Figure 6:
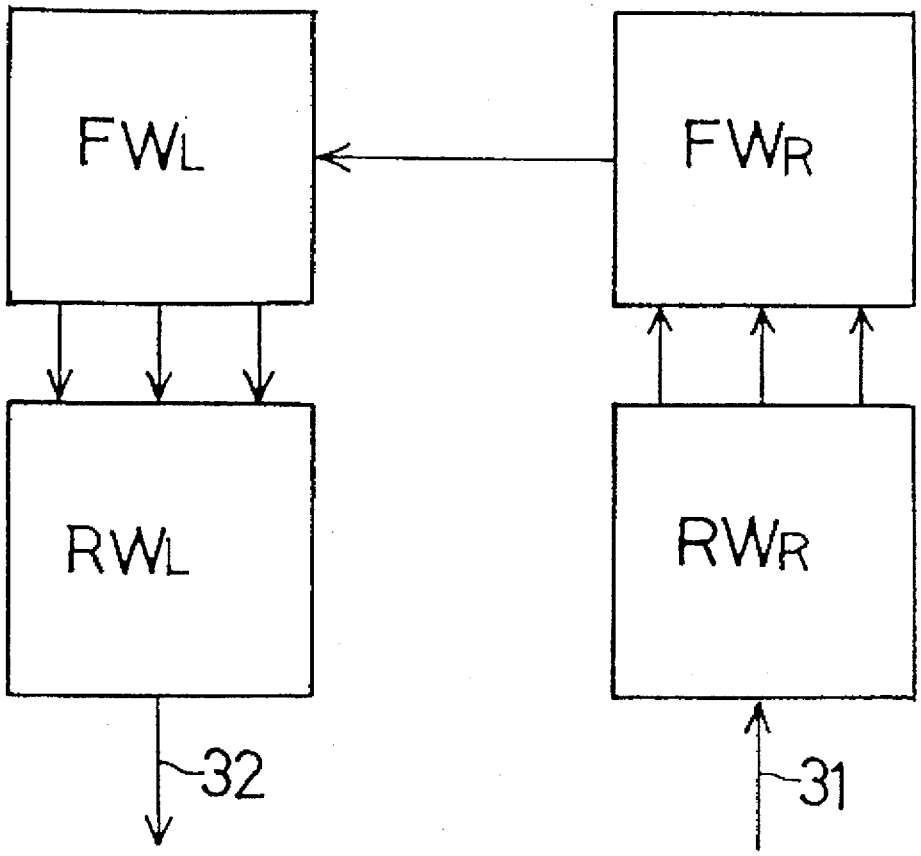
FIG. 6 is concerned with the viscous heater of the Second Preferred Embodiment, and is a schematic diagram for illustrating a flow of circulating water therein.

In the viscous heater thus constructed, the heated circulating water is used for heating a vehicle in the heating circuit in the same manner as the First Preferred Embodiment. At this moment, as illustrated in FIG. 6, the circulating water is taken in into a right-side chamber $RW_R$, viewed from the rear of the rear water jacket RW, through the water inlet port 31. Then, the circulating water follows the route in the water passages 33 through 35, and arrives at a right-side chamber $FW_R$, viewed from the rear of the front water jacket FW. Further, the circulating water arrives at a left-side chamber $FW_L$, viewed from the rear of the front water jacket FW. The left-side chamber $FW_L$ is formed integrally with the right-side chamber $FW_R$. Furthermore, the circulating water follows the route in the water passages 36 through 38, and arrives at a left-side chamber $RW_L$, viewed from the rear of the rear water jacket RW. Eventually, the circulating water is delivered out to the heating circuit through the water inlet port 32. Thus, in the viscous heater, there is no fear of short-circuiting or residing the circulating water in the rear water jacket RW, because the circulating water is circulated along the specific routes in the rear water jacket RW. In addition, heat exchange can be also carried out by the water passages 33 through 38 efficiently.

As a result, the viscous heater can be manufactured easily and less expensively, and is capable of carrying out full heat exchange.

Moreover, in the viscous heater, the rubber-like member of the shaft-sealing apparatus 10 is cooled indirectly by the circulating water which circulates in the front water jacket FW, because the front water jacket FW is formed up to the vicinity of the shaft-sealing apparatus 10. Accordingly, the fear of deteriorating the rubber-like member by the thermal effect, which results from the silicone oil held in the heat-generating chamber 30, is diminished. In addition, this advantageous effect realizes the temperature increment in the circulating water.

As a result, the viscous heater is capable of securely inhibiting the silicone oil from leaking even after durability.

Note that fins similar to those of the First Preferred Embodiment can be disposed in the front water jacket FW.

(Third Preferred Embodiment)

The viscous heater of the Third Preferred Embodiment embodies claims 1, 4, 5, 14 through 18, 20, and 21.

Figure 7:
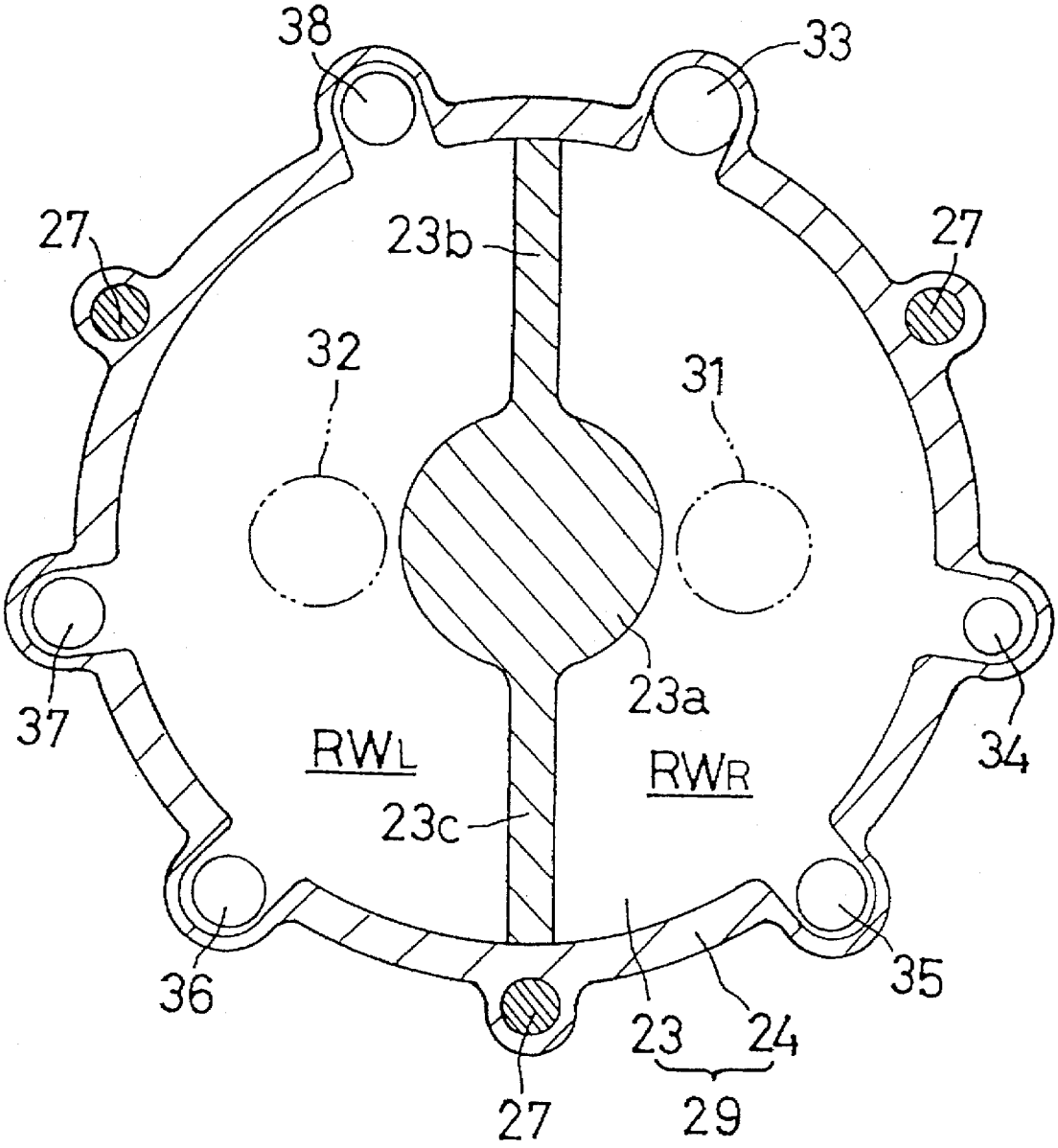
FIG. 7 is a horizontal cross-sectional view of a viscous heater of a Third Preferred Embodiment.

As illustrated in FIG. 7, a water passage 34 which is disposed nearest to a water inlet port 31 is formed to have the smallest diameter, and a water passage 35 which is disposed second nearest thereto is formed to have the second smallest diameter. Whilst, a water passage 33 which is disposed away therefrom is formed to have the largest diameter. Unless otherwise specified, the Third Preferred Embodiment has the same arrangements as those of the Second Preferred Embodiment.

In the viscous heater, it is somewhat troublesome to process the water passages 31 through 33. However, it is possible to carry out heat exchange efficiently, because circulating water, working as the circulating fluid, can flow in the fluid passages 31 through 33 in a flow rate of identical extent. The other operations and advantageous effects are identical with those of the Second Preferred Embodiment.

(Modified Version)

Figure 8:
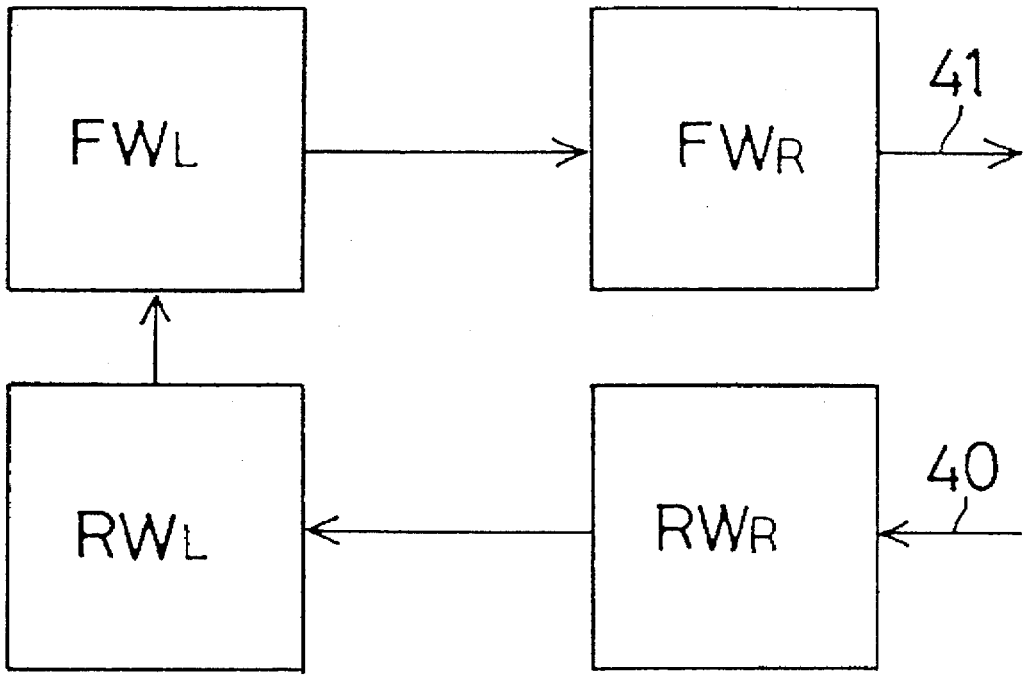
FIG. 8 is concerned with a viscous heater of a Modified Version, and is a schematic diagram for illustrating a flow of circulating water therein.

It is possible to arrange the specific routes of circulating water, working as the circulating fluid, in the manner as illustrated in FIG. 8. In this instance, the circulating water is taken in into a right-side chamber $RW_R$, viewed from the rear of the rear water jacket RW, through a water inlet port 40. The water inlet port 40 works as the first port, and the rear water jacket RW works as the rear radiator chamber. Further, the circulating water arrives at a left-side chamber $RW_L$, viewed from the rear of the rear water jacket RW. The left-side chamber $RW_L$ is formed integrally with the right-side chamber $RW_R$. Furthermore, the circulating water arrives at a left-hand side chamber $FW_L$, viewed from the rear of the front water jacket FW, along a route in a water passage (not shown). The water passage (not shown) works as the fluid passage, and the front water jacket FW works as the front radiator chamber. Moreover, the circulating water arrives at a right-side chamber $FW_R$, viewed from the rear of the front water jacket FW. The right-side chamber $FW_R$ is formed integrally with the left-side chamber $FW_L$. Eventually, the circulating water is delivered out to a heating circuit through a water outlet port 41. The water outlet port 41 works as the second port. Note that the water inlet port 40 and the water outlet port 41 are formed next to each other in the identical surface.

The viscous heater can operate and effect advantages in the same manner as the Second Preferred Embodiment.

(Fourth Preferred Embodiment)

The viscous heater of the Fourth Preferred Embodiment embodies claims 1 through 9, and 11 through 17.

Figure 9:
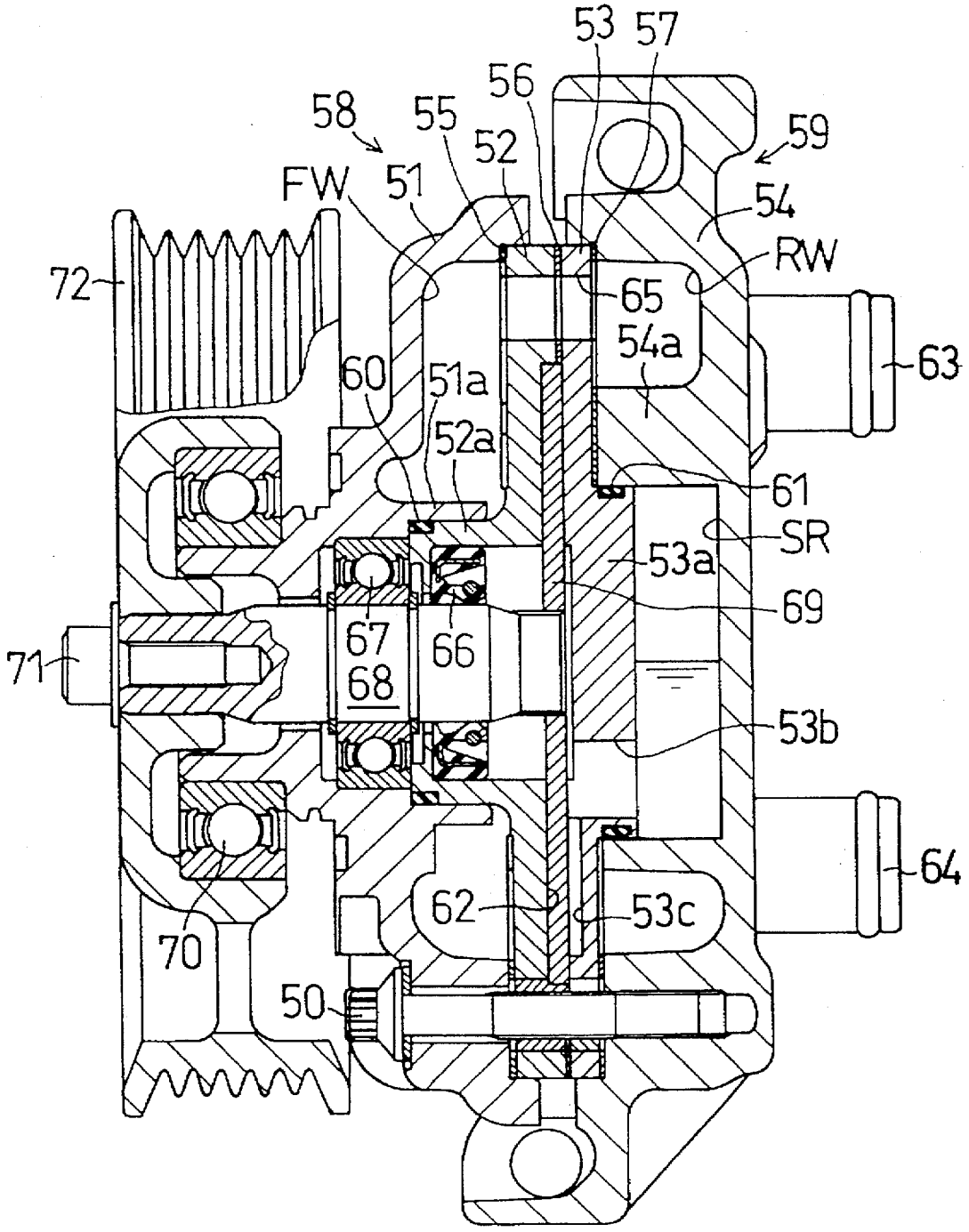
FIG. 9 is a horizontal cross-sectional view of a viscous heater of a Fourth Preferred Embodiment.

As illustrated in FIG. 9, in the viscous heater, a front housing body 51, a front plate 52, a rear plate 53 and a rear housing body 54 are overlapped and fastened at the peripheral portions by a plurality of through bolts 50. Here, a gasket 55 is interposed between the front housing body 51 and the front plate 52 at the outer peripheral portions; a gasket 56 is interposed between the front plate 52 and the rear plate 53 at the outer peripheral portions; and a gasket 57 is interposed between the rear plate 53 and the rear housing body 54 at the outer peripheral portions. The gaskets 55 through 57 work as the sealing member. In this instance, the front housing body 51 and the front plate 52 constitute a front housing 58, and the rear plate 53 and the rear housing body 54 constitute a rear housing 59.

The front housing body 51 is formed as a cup shape, and surrounds the outer-peripheral end of the front plate 52 with the outer peripheral portion. Further, the front plate 52 has a boss **52*a* in a central portion. The boss 52*a* protrudes in an axial direction, and works as the convexity. Furthermore, the front housing body 51 has a boss 51*a*. The boss 51*a* contacts with the boss 52*a* in an axial direction and in a peripheral direction, and works as the contacting portion. Moreover, an O-ring 60 is interposed between the corner of the boss 52*a* and the coroner of the boss 51*a***.

Whilst, the rear housing body 54 is formed as a cup shape, and surrounds the outer-peripheral end of the rear plate 53 with the outer peripheral portion. Further, the rear plate 53 has an axially-protruding cylinder-shaped convexity **53*a* in a central portion. Furthermore, the rear housing body 54 has a ring-shaped rib 54*a*. The rib 54*a* contacts with the convexity 53*a* in a peripheral direction, and works as the contacting portion. Moreover, an O-ring 61 is interposed between the peripheral surface of the convexity 53*a* and the peripheral surface of the rib 54*a***.

Further, a concavity is dented in a rear-end surface of the front plate 52, and forms a heat-generating chamber 62 together with a flat front-end surface of the rear plate 53. Furthermore, an inner surface of the front housing body 51 and a front-end surface of the front plate 52 form a front water jacket FW. The front water jacket FW works as the front radiator chamber neighboring in front the heat-generating chamber 62. Moreover, a rear-end surface of the rear plate 53 and an inner surface of the rear housing body 54 form a rear water jacket RW. The rear water jacket FW works as the rear radiator chamber neighboring in rear of the heat-generating chamber 62. Note that the inner surface of the rear housing body 54 herein means an inner surface thereof disposed outside with respect to the rib **54*a*. In addition, a rear-end surface of the rear plate 53 and an inner surface of the rear housing body 54 form a reservoir chamber SR. Note that the inner surface of the rear housing body 54 herein means an inner surface thereof disposed inside with respect to the rib 54*a***.

In a rear surface of the rear housing body 54, a water inlet port 63 and a water outlet port 64 are formed next to each other. The water inlet port 63 works as the first port, and the water outlet port 64 works as the second port. The water inlet port 31 and the water outlet port 32 are communicated with the rear water jacket RW. Moreover, in the rear plate 53 and the front plate 52, a plurality of water passages 65 are drilled through between the through bolts 50 at equal intervals. The water passages 65 work as the fluid passage. Thus, the front water jacket FW and the rear water jacket RW are communicated by the water passages 65.

In addition, a shaft-sealing apparatus 66 is disposed in the boss 52*a* of the front plate 52, and is placed so as to neighbor the heat-generating chamber 62. Moreover, a bearing apparatus 67 is disposed in the boss 51*a* of the front housing body 51. By way of the shaft-sealing apparatus 66 and the bearing apparatus 67, a driving shaft 68 is held rotatably. At the trailing end of the driving shaft 68, a plate-shaped rotor 69 is press-fitted so that it can rotate in the heat-generating chamber 62.

In the rear plate 53, a recovery hole (not shown) is drilled through up to the rear-end surface at an upper position in the central region, and at the same time a supply hole 53*b* is drilled through at a lower position in the central region. Note that the supply hole 53*b* has a larger communicative area than that of the recovery hole. Moreover, in the rear plate 53, a supply groove 53*c* is dented. Note that the supply groove 53*c* is opened on the side of the heat-generating chamber 62, and is communicated with the supply hole 53*b* at the inner end. Together with air, a silicone oil, held in the reservoir chamber SR, is interposed in the space between the wall surface of the heat-generating chamber 62 and the outer surface of the rotor 69. The silicone oil works as the viscous fluid. At the leading end of the driving shaft 68, a pulley 72 is connected by a bolt 71 via a bearing apparatus 70 which is disposed between the pulley 72 and the front housing body 51. The pulley 72 is rotated by a vehicle engine via a belt.

In the thus constructed viscous heater, even when the front housing body 51, and so on, are fastened by the through bolts 50 at the outer peripheral portions, the silicone oil, held in the heat-generating chamber 62, is less likely to leak to the outside. Further, the silicone oil is less likely to leak into the front and rear water jackets FW and RW. Furthermore, the circulating water, circulating in the front and rear water jackets FW and RW as the circulating fluid, is less likely to leak to the outside.

As a result, in the viscous heater, even when component parts of relatively small thickness are employed as the front and rear housing bodies 51 and 54, and the front and rear plates 52 and 53 for the purpose of weight reduction, it is possible to reliably inhibit the mutual leaking among the silicone oil, the circulating water and the outside air. Hence, the viscous heater can exhibit superb durability.

Unless otherwise specified, the viscous heater operates and produces advantages in the same manner as the First through Third Preferred Embodiments.

(Fifth Preferred Embodiment)

The viscous heater of the Fifth Preferred Embodiment embodies claims 1 through 8, 10, and 12 through 17.

Figure 10:
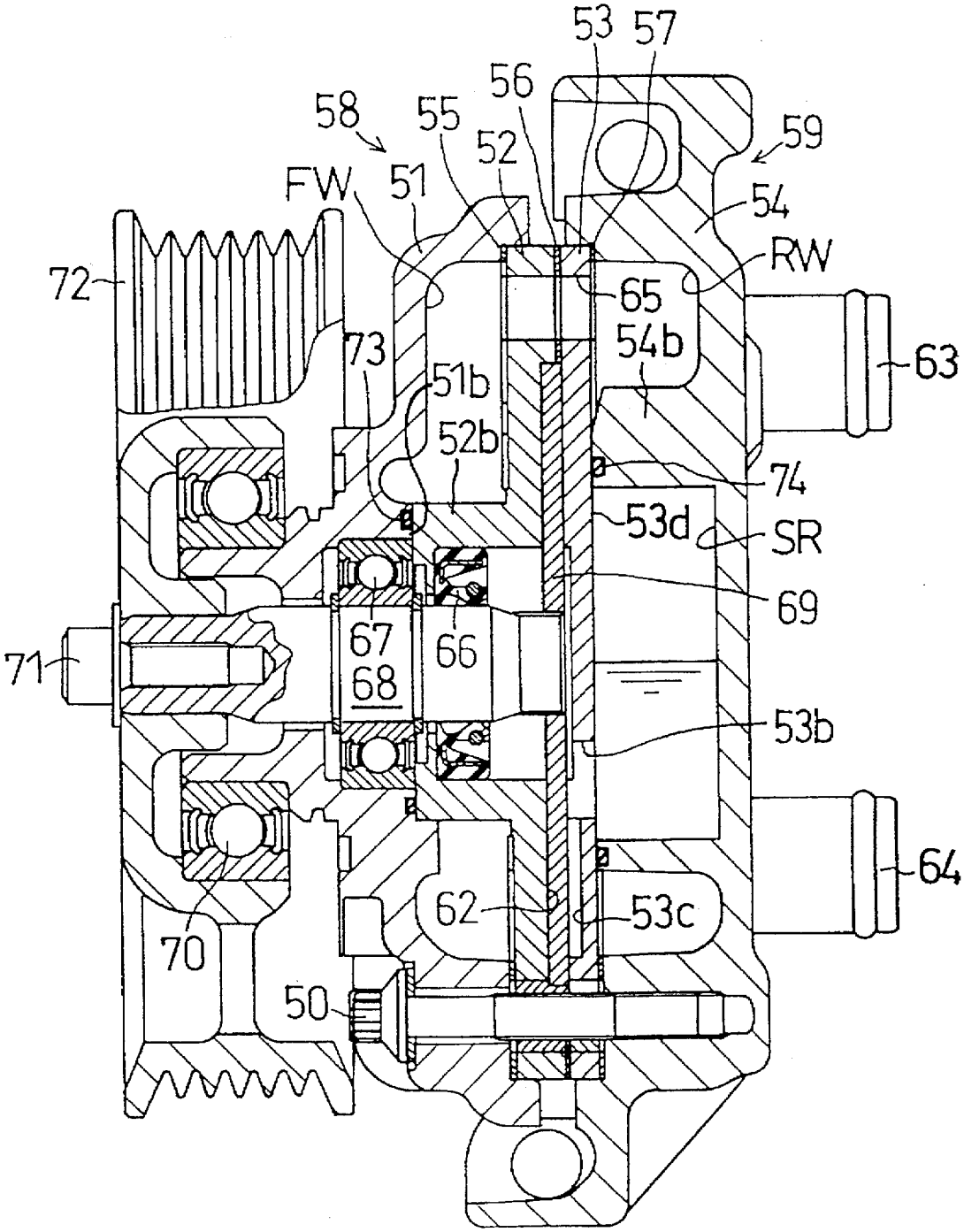
FIG. 10 is a horizontal cross-sectional view of a viscous heater of a Fifth Preferred Embodiment.

As illustrated in FIG. 10, in the viscous heater, a front plate 52 has a boss 52*b* in a central portion. The boss 52*b* protrudes in an axial direction, and works as the convexity. Further, the front housing body 51 has a receiving surface 51*b*. The receiving surface 51*b* contacts with the boss 52*b* in an axial direction, and works as the contacting portion. Furthermore, an O-ring 73 is interposed between the end surface of the boss 52*b* and the receiving surface 51*b*.

Whilst, a rear housing body 54 is provided with a ring-shaped rib 54*b*. The rib 54*b* contacts with a flat rear-end surface of a rear plate 53 in an axial direction. Moreover, an O-ring 74 is interposed between an end surface of the rib 54*b* and the flat rear-end surface 53*d*. Unless otherwise specified, the Fourth Preferred Embodiment has the same arrangements as those of the Fourth Preferred Embodiment.

The viscous heater of the Fifth Preferred Embodiment can operate and produce advantages in the same manner as the Fourth Preferred Embodiment.

As having described so far, the viscous heater set forth in the appended claims can produce the following advantages by employing the means recited in the claims.

The viscous heater set forth in claims 1 through 21 can be manufactured readily and less expensively.

Further, the viscous heater set forth in claims 12 through 15, 18, and 20 can carry out full heat exchange.

Furthermore, the viscous heater set forth in claims 2 through 11, and 21 can securely inhibit the mutual leakage among the viscous fluid, the circulating fluid and the outside air.

We claim:

1. A viscous heater, comprising:

a front housing and a rear housing in which a heat-generating chamber is formed;

a radiator chamber formed in one of said front and rear housings at least, neighboring said heat-generating chamber, and circulating a circulating fluid therein;

a driving shaft held rotatably to said front housing by way of a bearing apparatus;

a rotor disposed in said heat-generating chamber rotatably by said driving shaft; and a viscous fluid interposed in a space between a wall surface of said heat-generating chamber and an outer surface of said rotor, and caused to generate heat by said rotating rotor;

wherein at least one of said front and rear housings forming said radiator chamber includes a plate, and a housing body constituting the rest of at least one of said front and rear housings, the plate forming a wall surface of said heat-generating chamber with an axial end surface thereof and a wall surface of said radiator chamber with another axial end surface thereof; and the plate, the housing body and another one of said front and rear housings are overlapped and fastened by a through bolt.

2. A viscous heater according to claim 1, wherein an outer peripheral portion of said housing body surrounds an outer peripheral end of said plate.

3. A viscous heater according to claim 1, wherein said plate includes a convexity which protrudes at a central portion in an axial direction, and said housing body includes a contacting portion which is brought into contact with the convexity in an axial direction or in a peripheral direction.

4. A viscous heater according to claim 1, wherein a sealing member is interposed between said plate and said housing body.

5. A viscous heater according to claim 4, wherein said sealing member is a gasket.

6. A viscous heater according to claim 4, wherein said sealing member is capable of displacing in an axial direction.

7. A viscous heater according to claim 5, wherein said gasket is interposed between an outer peripheral portion of said housing body and an outer peripheral portion of said plate, or said axially-displaceable sealing member is interposed between a central portion of said housing body and a central portion of said plate.

8. A viscous heater according to claim 6, wherein said axially-displaceable sealing member is an O-ring.

9. A viscous heater according to claim 1, wherein said plate has a convexity which protrudes in an axial direction at a central portion thereof; said housing body has a contacting portion which is brought into contact with the convexity in a peripheral direction; and an O-ring is interposed between a peripheral surface of the convexity and a peripheral surface of the contacting portion.

10. A viscous heater according to claim 1, wherein said plate has a convexity which protrudes in an axial direction at a central portion thereof; said housing body has a contacting portion which is brought into contact with the convexity in an axial direction; and an O-ring is interposed between an end surface of the convexity and an end surface of the contacting portion.

11. A viscous heater according to claim 1, wherein said plate has a convexity which protrudes in an axial direction at a central portion thereof; said housing body has a contacting portion which is brought into contact with the convexity in an axial direction; and an O-ring is interposed between a corner of the convexity and a corner of the contacting portion.

12. A viscous heater according to claim 1, wherein a wall surface of said plate or said housing body, forming said radiator chamber, constitutes a fin which protrudes in an axial direction.

13. A viscous heater according to claim 12, wherein a leading end of said fin is brought into contact with said housing body or said plate.

14. A viscous heater according to claim 1, wherein said rear housing, forming said rear radiator chamber, includes a rear plate, and a rear housing body constituting the rest of said rear housing, the rear plate forming a rear wall surface of said heat-generating chamber with a front end surface thereof and a front wall surface of said rear radiator chamber with a rear end surface thereof; and the rear plate and the rear housing body are brought into contact with each other at central regions thereof.

15. A viscous heater according to claim 1, wherein said radiator chamber is constituted so as to circulate said circulating fluid, taken in through a first port, along a specific route, and to deliver said circulating fluid out to said external heating circuit through a second port.

16. A viscous heater according to claim 15, wherein said first port and said second port are formed in an identical surface.

17. A viscous heater according to claim 16, wherein said first port and said second port are disposed next to each other.

18. A viscous heater according to claim 15, wherein said front housing, forming said front radiator chamber, includes a front plate, and a front housing body constituting the rest of said front housing, the front plate forming a front wall surface of said heat-generating chamber with a rear end surface thereof and a rear wall surface of said front radiator chamber with a front end surface thereof;

said rear housing, forming said rear radiator chamber, includes a rear plate, and a rear housing body constituting the rest of said rear housing, the rear plate forming a rear wall surface of said heat-generating chamber with a front end surface thereof and a front wall surface of said rear radiator chamber with a rear end surface thereof; and a plurality of fluid passages communicate from one of said front radiator chamber and said rear radiator chamber, in which said first port and said second port are formed, to another one thereof.

19. A viscous heater according to claim 18, wherein said fluid passages are formed to have an identical cross-sectional area, respectively.

20. A viscous heater according to claim 18, wherein said fluid passages are formed to have a smaller cross-sectional area near said first port, and are formed to have a larger cross-sectional area away from said first port.

21. A viscous heater according to claim 1, wherein said front housing, forming said front radiator chamber, includes a front plate, and a front housing body constituting the rest of said front housing, the front plate forming a front wall surface of said heat-generating chamber with a rear end surface thereof and a rear wall surface of said front radiator chamber with a front end surface thereof;

said front plate or said front housing body is provided with a shaft-sealing apparatus which seals said driving shaft between said heat-generating chamber and said bearing apparatus; and said front radiator chamber is formed adjacent to said shaft-sealing apparatus.

* * * * *